US006860243B2

(12) United States Patent
Doherty et al.

(10) Patent No.: US 6,860,243 B2
(45) Date of Patent: Mar. 1, 2005

(54) COMBUSTION CHAMBER SYSTEM WITH OBSTACLES FOR USE WITHIN COMBUSTION-POWERED FASTENER-DRIVING TOOLS, AND COMBUSTION-POWERED FASTENER-DRIVING TOOLS HAVING COMBUSTION CHAMBER SYSTEM INCORPORATED THEREIN

(75) Inventors: James E. Doherty, Barrington, IL (US); James W. Robinson, Mundelein, IL (US); Richard Urban, Prospect Heights, IL (US); Christian Paul Andre Ricordi, Bourg-les-Valence (FR); Donald L. Van Erden, Wildwood, IL (US); Larry M. Moeller, Mundelein, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/175,537

(22) Filed: Jun. 18, 2002

(65) Prior Publication Data

US 2003/0230256 A1 Dec. 18, 2003

(51) Int. Cl.[7] ..... F02B 71/00
(52) U.S. Cl. ..... 123/46 R
(58) Field of Search ..... 123/46 R, 46 H, 123/46 SC, 46 A, 46 B, 267, 285, 286, 287

(56) References Cited

U.S. PATENT DOCUMENTS

| | | | | |
|---|---|---|---|---|
| 4,365,471 A | | 12/1982 | Adams | |
| 4,510,748 A | | 4/1985 | Adams | |
| 4,522,162 A | * | 6/1985 | Nikolich | 123/46 SC |
| 4,665,868 A | | 5/1987 | Adams | |
| 4,759,318 A | | 7/1988 | Adams | |
| 4,773,581 A | | 9/1988 | Ohtsu et al. | |
| 5,000,128 A | | 3/1991 | Veldman | |
| 5,199,626 A | | 4/1993 | Terayama et al. | |
| 5,213,247 A | * | 5/1993 | Gschwend et al. | 227/10 |
| 6,378,288 B1 | | 4/2002 | Towfighi et al. | |

FOREIGN PATENT DOCUMENTS

| | | |
|---|---|---|
| DE | 199 62 584 | 6/2001 |
| DE | 199 62 697 | 6/2001 |
| DE | 199 62 711 | 7/2001 |
| EP | 1 093 886 | 9/2000 |

* cited by examiner

*Primary Examiner*—Tony M. Argenbright
*Assistant Examiner*—Hyder Ali
(74) *Attorney, Agent, or Firm*—Schwartz & Weinrieb

(57) ABSTRACT

A combustion chamber system, for use within a combustion-powered fastener-driving tool, comprises a dual combustion chamber system comprising a pre-combustion chamber and a final combustion chamber. The pre-combustion chamber is characterized by a high aspect ratio and has different obstacles fixedly incorporated therein for selectively retarding and enhancing the rate of burn and the rate of speed of the flame front propagating through the pre-combustion chamber. In addition, an obstacle, having a predetermined solid geometrical configuration is disposed within the final combustion chamber at a position immediately disposed downstream of a port fluidically interconnecting the pre-combustion chamber to the final combustion chamber so as to cause the flame front to diverge and split into multiple components which flow radially outwardly throughout the final combustion chamber.

54 Claims, 5 Drawing Sheets

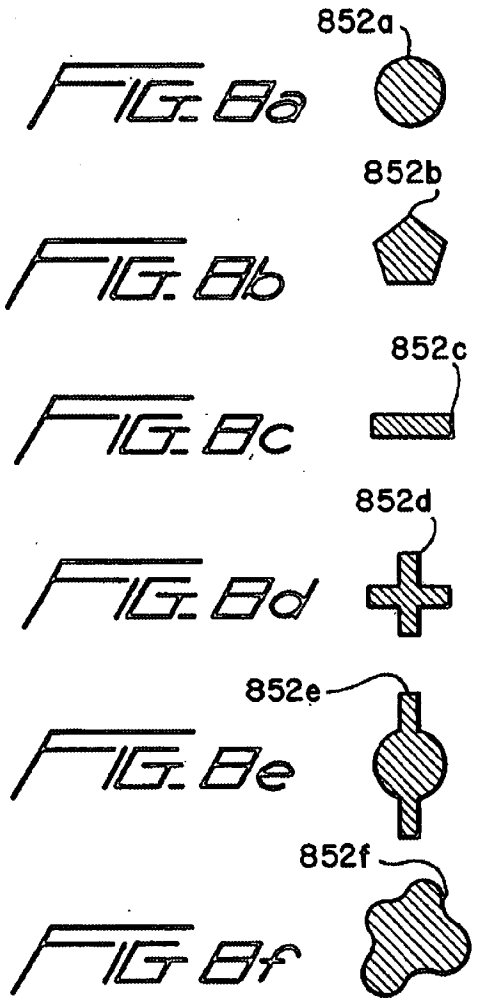
FIG. 8a
FIG. 8b
FIG. 8c
FIG. 8d
FIG. 8e
FIG. 8f
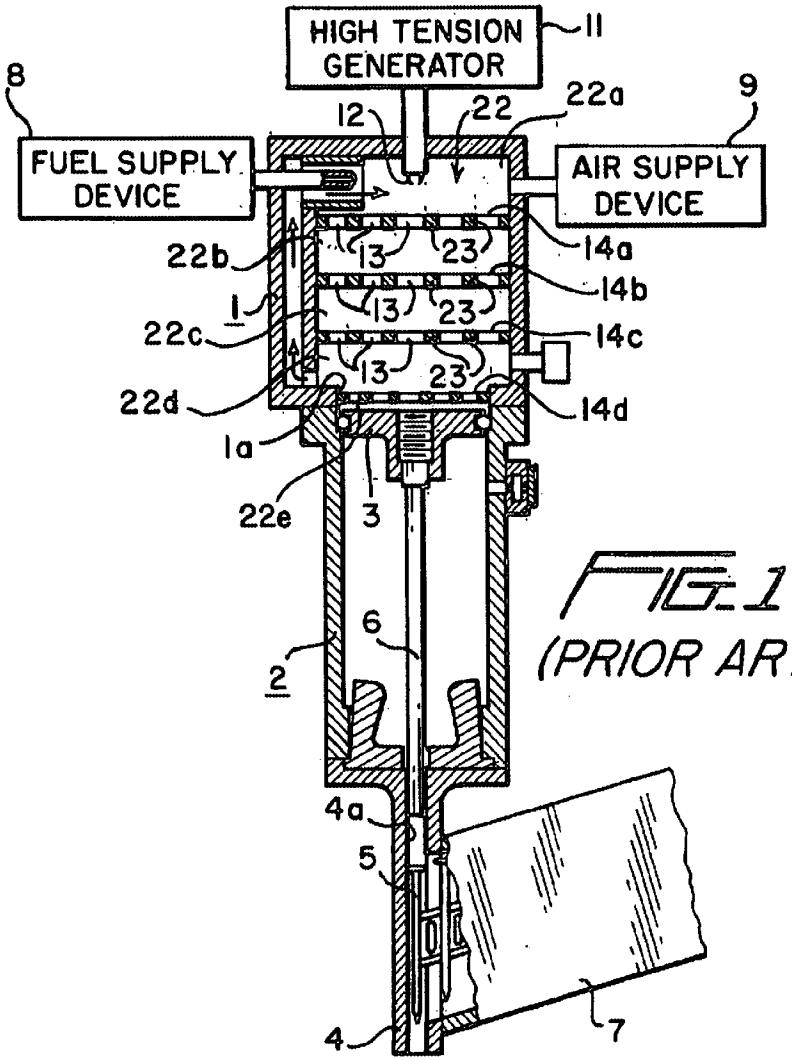
FIG. 1
(PRIOR ART)

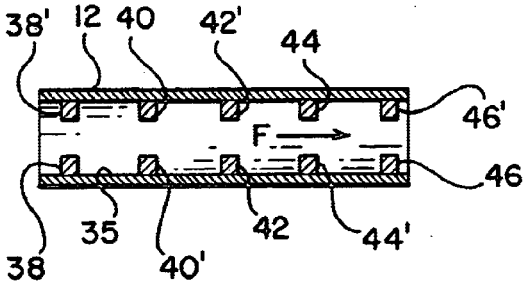
FIG. 4
FIG. 5
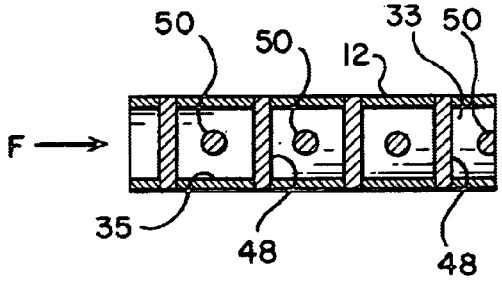
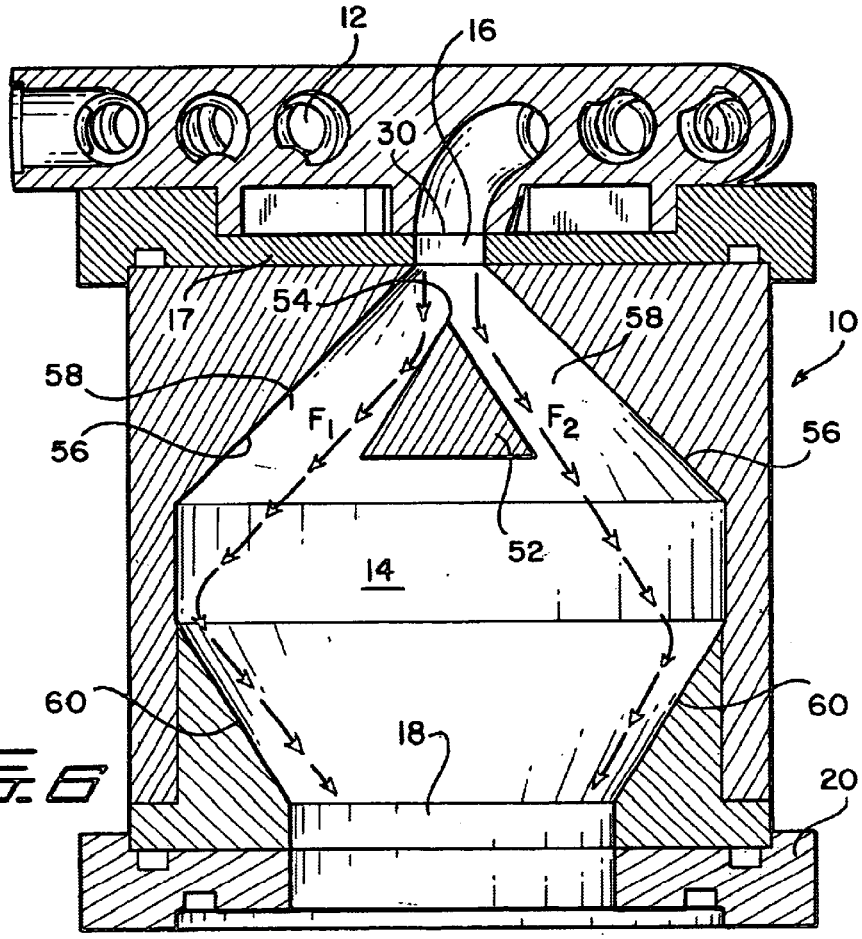
FIG. 6

58
56
17
16
14
8
52
8
158
156
152
114
116
258
256
252
214
216
358
356
314
352
316
414
452
416
$F_2$
$F_1$
456
458
552
516
514
558
556
614
652
616
656
658
714
752
$F_2$
$F_1$
716
756
758

COMBUSTION CHAMBER SYSTEM WITH OBSTACLES FOR USE WITHIN COMBUSTION-POWERED FASTENER-DRIVING TOOLS, AND COMBUSTION-POWERED FASTENER-DRIVING TOOLS HAVING COMBUSTION CHAMBER SYSTEM INCORPORATED THEREIN

FIELD OF THE INVENTION

The present invention relates generally to a combustion chamber system for use within combustion-powered fastener driving tools, as well as the combustion-powered fastener-driving tools having the combustion chamber incorporated therein, and more particularly to a new and improved combustion chamber system for use within combustion-powered fastener driving tools for driving fasteners into workpieces or substrates wherein the combustion chamber system comprises a pre-combustion chamber and a final combustion chamber, wherein the pre-combustion chamber has an aspect ratio, which is defined by the ratio of the length of the pre-combustion chamber as compared to the width of the pre-combustion chamber, which is at least 2:1 such that the performance or output power levels of the combustion process can be dramatically improved so as to effectively result in greater driving forces, greater acceleration and velocity levels of the working piston, and greater depths to which the fasteners can be driven into their respective substrates, and wherein further, predetermined or different types of obstacles are fixedly incorporated within both the pre-combustion and final combustion chambers for respectively optimally controlling, either by increasing or retarding, the rate of burn and the speed at which the flame jet or flame front not only propagates within and through the pre-combustion chamber, but also the rate or speed at which the flame front or flame jet enters the final combustion chamber, and for ensuring that the entire unburned air-fuel mixture within the final combustion chamber is in fact fully and rapidly ignited such that a peak amount of pressure is effectively impressed upon the working or fastener-driving piston in the shortest possible time so as to in turn develop the desired amount of peak energy or power for moving the piston-driver blade assembly for discharging the fasteners from the tool and for driving the same into a particular workpiece or substrate.

BACKGROUND OF THE INVENTION

Combustion-powered fastener-driving tools, for driving fasteners into workpieces or substrates, are conventionally well-known and are highly desirable within the industry in view of the fact that they provide users with the ability to drive fasteners into the workpieces or substrates independent of any cord or hose attachments to remote power sources. These tools normally comprise a combustion chamber, an on-board fuel supply, means for igniting a combustible gaseous mixture within the combustion chamber, and an expansion volume-driven piston having a driver blade operatively connected thereto for driving fasteners out from the tool and into the workpieces or substrates. It is further known that the effective fastener-driving power for these tools is dependent upon the initial absolute pressure of the combustible gaseous mixture at the time of ignition, the rate at which the gaseous mixture burns within the combustion chamber, the controlled retarded movement of the piston while combustion takes place, and the maximum combustion pressure that can be achieved. In view of the fact that the burn rate is directly proportional to turbulence, a first known type of combustion-powered fastener-driving tool achieves a high burn rate by having a fan disposed within the combustion chamber for the creation of turbulence. The burn rate is therefore rapid enough such that a high combustion pressure level can be desirably achieved within this tool before the piston-driver blade assembly can move to a great degree.

A second known type of combustion-powered fastener-driving tool utilizes a two or dual combustion chamber system comprising, for example, a pre-combustion chamber and a final combustion chamber, and wherein a one-way valve member is interposed between the two combustion chambers so as to control the fluid flow between the two combustion chambers whereby a higher maximum combustion pressure is able to be achieved within the second or final combustion chamber. The first or pre-combustion chamber has an elongated configuration whereby the aspect ratio thereof, which is defined as the ratio of the longitudinal length of the pre-combustion chamber relative to the width or diametrical extent of the pre-combustion chamber, is greater than two. As a result of such structure, the unburned air-fuel mixture is forced ahead of the flame front as it progresses from the upstream ignition end of the pre-combustion chamber toward the downstream end of the pre-combustion chamber within which the one-way valve member is located. Combustion occurs within the second or final combustion chamber when the flame front passes through the one-way valve member into the second or final combustion chamber wherein the final maximum combustion pressure achieved within the second or final combustion chamber is directly proportional to the amount of the combustible mixture pushed into the second or final combustion chamber from the first or pre-combustion chamber. By constructing the pre-combustion chamber with a relatively high aspect ratio, it was discovered that more unburned fuel and air can be pushed ahead of the flame front and into the final combustion chamber than was previously possible with conventional combustion chamber systems characterized by low aspect ratios, whereby the combustion pressure within the final combustion chamber was elevated thereby leading to more efficient combustion within the final combustion chamber and the generation of higher operating pressures to be impressed upon the working piston-driver blade assembly.

An example of such a dual combustion chamber system is disclosed within the United States patent application entitled COMBUSTION-CHAMBER SYSTEM WITH SPOOL-TYPE PRE-COMBUSTION CHAMBER which was filed on Jan. 16, 2002 in the name of Donald L. Van Erden et al. and assigned Ser. No. 10/050836, the principles of which are incorporated herein by reference. A third known type of combustion-powered fastener-driving tool is substantially similar to the second known type of combustion-powered fastener-driving tool except that additional structure is incorporated within the tool for positively restraining any movement of the piston until the air-fuel mixture is ignited within the second or final combustion chamber.

While the aforenoted combustion-powered fastener-driving tools comprise and exhibit various positive structural and operational features and have therefore obviously been commercially successful, such combustion-powered fastener-driving tools also have or exhibit several operational disadvantages or drawbacks. For example, the use of a fan within the combustion chamber in order to create the requisite amount of turbulence to accelerate the burn rate of the air-fuel combustible mixture nevertheless requires a drive motor. While small compact motors of the type required for operation within such fastener-driving tools are commercially available, the motors are expensive because they must be specially designed and fabricated in such a manner as to be capable of withstanding the repetitive jarring forces characteristic of the fastener-driving operations. In addition, the motors also experience periodic failure thereby requiring the tool to be regularly serviced. In a similar manner, while the use of one-way flow check valves at the aforenoted locations between the pre-combustion and final combustion chambers in order to effectively prevent pressure losses due to backflow from the final combustion chamber to the pre-combustion chamber, the check valves must also be specially designed so as to be light enough to permit the unobstructed flow of both the unburned air-fuel mixture and the propagating flame front in the forward direction, and yet be rugged enough to be capable of resisting the high stresses imposed thereon when it moves to its CLOSED position when combustion is initiated within the second or final combustion chamber. In particular, experience has shown that such valves often distort and deform within relatively short periods of time or as a result of a relatively small number of operational cycles thereby requiring their frequent replacement. Lastly, while the piston-restraining systems may exhibit optimal operational characteristics as considered or viewed from a properly timed combustion point of view, such systems obviously require the use of additional components which add cost and weight factors to the tools, as well as additional maintenance requirements.

In order to further attempt to control the generation of turbulence within the combustion chamber, the burn rate of the air-fuel mixture within the combustion chamber, and the propagation flow rate of both the unburned air-fuel mixture and the flame front within the combustion chamber, another type of conventional or PRIOR ART combustion-powered fastener-driving tool is disclosed within U.S. Pat. No. 4,773,581 which issued to Ohtsu et al. on Sep. 27, 1988. Briefly, as can be appreciated from FIG. 1, which corresponds substantially to FIG. 1 of the noted patent, the combustion-powered fastener-driving tool is seen to comprise a cylindrical housing or cylinder head 1 wherein, for example, the upper end of the housing or head 1 is closed while the lower end of the housing or head 1 is open as at 1*a*. The cylinder head or housing 1 effectively defines a combustion chamber 22, and a second cylinder 2 is fixedly connected in a substantially coaxial manner to the lower end of the cylinder head or housing 1 so as to effectively define a piston chamber within which a piston 3 is movably disposed. A cylindrical guide member 4 is fixedly connected in a substantially coaxial manner to the lower end of the second cylinder 2, and a fastener magazine 7, housing a plurality or strip of fasteners 5, is fixedly attached to a side wall of the cylindrical guide member 4 so as to permit the serial feeding of the plurality of fasteners 5 into an internal guide bore 4*a* defined within the guide member 4. An upper end portion of a fastener driver or drive rod 6 is fixedly attached to the piston 3, while a lower end portion of the fastener driver or drive rod 6 is coaxially disposed within the guide bore 4*a* of the guide member 4.

Accordingly, when the piston 3 is forced downwardly under combustion conditions initiated when the tool is fired, the fastener driver or drive rod 6 will drive the leading fastener 5 through the guide bore 4*a* of the guide member 4 so as to be discharged from the tool. In order to achieve combustion conditions within the tool, a fuel supply device 8 is operatively connected to an upper end portion of the housing or head 1 so as to inject fuel into the upper end portion of the combustion chamber 22, and in a similar manner, an air supply device 9 is likewise operatively connected to an upper end portion of the housing or head 1 so as to inject air into the upper end portion of the combustion chamber 22 whereby the air and fuel injected into the combustion chamber 22 will form an air-fuel mixture. A high tension generator 11, for generating a high voltage discharge, is mounted upon the upper end wall of the housing or head 1 and has a spark plug 12 operatively connected thereto for generating an ignition spark when energized by the generator 11. In order to enhance the turbulence and the mixing together of the air and fuel components of the air-fuel mixture charged into the combustion chamber 22, a plurality of gratings or grilles 14*a*, 14*b*, 14*c*, 14*d* are disposed within the combustion chamber 22 so as to extend transversely across the combustion chamber 22 and thereby be disposed within parallel planes which are substantially perpendicular to the longitudinal axis of the tool. Accordingly, the grilles 14*a*, 14*b*, 14*c*, 14*d* effectively divide the combustion chamber 22 into sub-combustion chambers 22*a*, 22*b*, 22*c*, 22*d*, 22*e*. In particular, each one of the grilles or gratings 14*a*–14*d* may comprise, for example, a perforated disc wherein a plurality of apertures 13 are effectively defined between a network of wall portions 23.

In operation, when air and fuel have been injected into the sub-combustion chamber 22*a* so as to form an air-fuel mixture, and when such air-fuel mixture has effectively filled the entire combustion chamber 22 as a result of movement or migration from sub-combustion chamber 22*a* into sub-combustion chambers 22*b*–22*e* through means of the apertures 13 respectively defined within the gratings or grilles 14*a*–14*d*, the high tension generator 11 is energized so as to in turn cause the spark plug 12 to generate an ignition spark. As is known, when the spark ignites the air-fuel mixture within the sub-combustion chamber 22*a*, the mixture burns and a flame occurs. The resulting combustion gas within the sub-combustion chamber 22*a* expands and forces the unburned mixture toward the piston 3 through means of the apertures 13 defined within the gratings or grilles 14*a*–14*d*. As the unburned mixture successively passes through the apertures 13 defined within each one of the gratings or grilles 14*a*–14*d*, the network of wall portions 23 comprising the gratings or grilles 14*a*–14*d* effectively form obstacles to the flow of such unburned mixture, and, in turn, the obstacles effectively cause turbulence within the downstream regions of the unburned mixture. Accordingly, as the flame also traverses the grating or grille 14*a* through means of the apertures 13, and as a result of the turbulence generated within the unburned air-fuel mixture, it is stated that the flame front advances at a higher rate of speed within the sub-combustion chamber 22*b*. In turn, the higher rate of speed of the flame front increases the speed of expansion of the resulting combustion gas thereby also increasing the speed of flow of the unburned mixture from the sub-combustion chamber 22*b* to the sub-combustion chamber 22*c*.

As a result, stronger turbulence occurs within the unburned air-fuel mixture present within the sub-combustion chamber 22*c*, and in turn, the stronger turbulence within the unburned air-fuel mixture present within the sub-combustion chamber 22*c* causes the flame front to proceed or advance at a rate of speed which is higher or greater than that present within the preceding sub-combustion chamber 22*b*. Therefore, according to the disclosure of such patent, it is also stated that the speed of the flame front progressively increases each time it successively passes through each one of the grilles or gratings 14*a*–14*d*. In this manner, the rapid combustion of the air-fuel mixture is apparently ensured so as to empower the piston 3 and the fastener driver or drive rod 6 whereby a leading one of the fasteners 5 can be driven out from the tool and into the particular workpiece or substrate. It is therefore noted that while the aforenoted PRIOR ART combustion-powered fastener-driving tool of Ohtsu et al. comprises the use of obstacle structures within the sub-combustion chambers in order to advantageously successively or serially affect the turbulence conditions, the burn rate of the air-fuel mixture, and the propagation flow rate of both the unburned air-fuel mixture and the flame front, within the plurality of sub-combustion chambers 22*a*–22*e*, it is submitted that the PRIOR ART combustion system of Ohtsu et al. comprises a combustion system which effectively exhibits a cascade type mode of combustion which is not truly advantageous in connection with the promotion or development of the aforenoted attributes or characteristics.

More particularly, in practice, the effectiveness of the provision or presence of the successive orifice plates rapidly deteriorates because each successive plate or screen actually results, even briefly, in a momentary interruption of the propagation speed of the flame front before it again regenerates the turbulence needed to maintain or enhance the propagation speed of the flame front. In addition, the structure of Ohtsu et al. does not provide adequate separation of the unburned and burned components of the air-fuel mixture. Advantageously, each plate structure of Ohtsu et al. causes the flame front to be divided into a plurality of segments or fingers which increases the surface area so as to enhance the burn rate, however, the plates also tend to cause the flame front or burning to proceed or occur laterally as well as forwardly thereby mixing together the burned and unburned components of the air-fuel mixture and causing dilution in the burning properties of the system. Still further, it does not appear that the combustion system of Ohtsu et al. viably achieves various operational parameters which are deemed crucial or critical to desired operational levels of current state-of-the-art technological combustion-powered fastener-driving tools. More particularly, the combustion system of Ohtsu et al. does not appear to be concerned with a dual combustion chamber system, and does not appear to be capable of optimally controlling, both in enhancement and retardation modes, the rate of burn of the air-fuel mixture, as well as the speed at which the flame jet or flame front not only propagates within and through, for example, a pre-combustion chamber of a dual combustion-chamber system, but in addition, the speed at which the flame jet or flame front enters the final combustion chamber. Still yet further, the system of Ohtsu et al. also does not appear to comprise means for ensuring that the entire unburned air-fuel mixture within the final combustion chamber is in fact fully and rapidly ignited such that a peak amount of pressure is effectively impressed upon the working or fastener-driving piston, without any deleterious backward or reverse reflection therefrom, so as to in turn develop the desired amount of peak energy or power for axially moving the working piston-driver blade assembly so as to discharge the fasteners from the tool and to drive the same into a particular workpiece or substrate.

A need therefore exists in the art for a new and improved combustion chamber system for use within a combustion-powered fastener-driving tool, and a new and improved combustion-powered fastener-driving tool having the new and improved combustion chamber system incorporated therein, for optimally controlling, both in enhancement and retardation modes, the rate of burn of the air-fuel mixture, and the speed at which the flame jet or flame front not only propagates within and through, for example, a first pre-combustion chamber of a dual combustion-chamber system, but in addition, the speed at which the flame jet or flame front enters the second or final combustion chamber, and still further, a system for ensuring that the entire unburned air-fuel mixture within the second or final combustion chamber is in fact fully and rapidly ignited such that a peak amount of pressure is effectively impressed upon the working or fastener-driving piston, in the shortest amount of time, without any deleterious backward or reverse reflection therefrom, so as to in turn develop the desired amount of peak energy or power for moving the working piston-driver blade assembly so as to discharge the fasteners from the combustion-powered fastener-driving tool and for driving the fasteners into a particular workpiece or substrate.

OBJECTS OF THE INVENTION

Accordingly, it is an object of the present invention to provide a new and improved combustion chamber system for use within a combustion-powered fastener-driving tool, and a new and improved combustion-powered fastener-driving tool having the new and improved combustion chamber system incorporated therein.

Another object of the present invention is to provide a new and improved combustion chamber system for use within a combustion-powered fastener-driving tool, and a new and improved combustion-powered fastener-driving tool having the new and improved combustion chamber system incorporated therein, which effectively overcomes the various operational drawbacks and disadvantages characteristic of conventional or PRIOR ART combustion-powered fastener-driving tools.

An additional object of the present invention is to provide a new and improved combustion chamber system for use within a combustion-powered fastener-driving tool, and a new and improved combustion-powered fastener-driving tool having the new and improved combustion chamber system incorporated therein, which can optimally control, both in enhancement and retardation modes, the rate of burn and the speed at which the flame jet or flame front not only propagates within and through, for example, a pre-combustion chamber of a dual combustion-chamber system, but in addition, the speed at which the flame jet or flame front enters and progresses through the final combustion chamber.

A further object of the present invention is to provide a new and improved combustion chamber system for use within a combustion-powered fastener-driving tool, and a new and improved combustion-powered fastener-driving tool having the new and improved combustion chamber system incorporated therein, which can optimally control, both in enhancement and retardation modes, the rate of burn and the speed at which the flame jet or flame front not only propagates within and through, for example, a pre-combustion chamber of a dual combustion-chamber system, but in addition, the speed at which the flame jet or flame front enters the final combustion chamber, and still further, which can ensure the complete and rapid ignition of the entire unburned air-fuel mixture present within the final combustion chamber.

A last object of the present invention is to provide a new and improved combustion chamber system for use within a combustion-powered fastener-driving tool, and a new and improved combustion-powered fastener-driving tool having the new and improved combustion chamber system incorporated therein, which can optimally control, both in enhancement and retardation modes, the rate of burn and the speed at which the flame jet or flame front not only propagates within and through, for example, a pre-combustion chamber of a dual combustion-chamber system, but in addition, the speed at which the flame jet or flame front enters and progresses through the final combustion chamber, and still further, which can ensure the complete and rapid ignition of the entire unburned air-fuel mixture present within the final combustion chamber such that a peak amount of pressure is effectively impressed upon the working or fastener-driving piston, without deleterious backward or reverse reflection therefrom, so as to in turn develop the desired amount of peak energy or power for moving the piston-driver blade assembly for discharging the fasteners from the tool and for driving the same into a particular workpiece or substrate.

SUMMARY OF THE INVENTION

The foregoing and other objectives are achieved in accordance with the teachings and principles of the present invention through the provision of a new and improved combustion chamber system for use within a combustion-powered fastener-driving tool, and a new and improved combustion-powered fastener-driving tool having the new and improved combustion chamber system incorporated therein, wherein the combustion chamber system comprises, for example, a dual combustion chamber system comprising a first, upstream pre-combustion chamber and a second, downstream final combustion chamber. The first, upstream pre-combustion chamber is characterized by means of a high aspect ratio, as defined by means of the ratio of the length of the pre-combustion chamber relative to the width or diametrical extent of the pre-combustion chamber, and has predeterminedly different obstacles fixedly incorporated therein for either selectively retarding or enhancing the rate of burn and the rate of speed of the flame jet or flame front propagating through such first, upstream pre-combustion chamber. More particularly, obstacles which either extend in effect transversely or diametrically across the pre-combustion chamber at different axial positions along the axial or longitudinal extent of the pre-combustion chamber, or which are disposed in effect substantially along the axial center of the pre-combustion chamber at different axial positions along the axial or longitudinal extent of the pre-combustion chamber, will tend to retard or slow down the rate of burn and the rate of speed of the flame jet or flame front propagating through the pre-combustion chamber, while, alternatively, obstacles which are in effect disposed in a substantially circumferential manner along the inner periphery of the pre-combustion chamber, at different axial positions along the axial or longitudinal extent of the pre-combustion chamber, will tend to enhance or increase the rate of burn and the rate of speed of the flame jet or flame front propagating through the pre-combustion chamber.

In a similar manner, an obstacle having a predetermined three-dimensional or solid geometrical configuration is disposed within the second, downstream final combustion chamber at a position immediately disposed downstream of the port fluidically interconnecting the first upstream pre-combustion chamber to the second downstream final combustion chamber. In this manner, as the flame jet or flame front enters the final combustion chamber, the flame jet or flame front effectively diverges and is split into multiple sections or components which flow radially outwardly toward the walls of the final combustion chamber, and which therefore traverse the entire diametrical extent of the final combustion chamber so as to thereby completely and rapidly ignite all regions of the unburned air-fuel mixture present within the final combustion chamber. The flame jet or flame front eventually encounters the working piston, by which time the pressure forces developed as a result of the rapid but controlled combustion within the final combustion chamber can effectively act upon the working piston so as to cause movement of the piston-driver assembly with the desired peak energy and power so as to in turn cause the particular fastener disposed within the guide tube of the tool to be discharged and driven into the particular substrate or workpiece.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein:

FIG. 1 is a cross-sectional view of one type of conventional or PRIOR ART combustion-powered fastener-driving tool;

FIG. 4 is a schematic view of a second embodiment of a combustion rate and flame jet propagation enhancement obstacle structure, in the form of a plurality of axially spaced annular washers formed or fixed upon internal peripheral wall portions of the pre-combustion chamber so as to extend throughout the axial or longitudinal extent thereof, which have been developed in accordance with the principles and teachings of the present invention;

FIG. 5 is a schematic view of a third embodiment of combustion rate and flame jet propagation retardation obstacle structure, in the form of a plurality of axially spaced pins, plates, spheres, and the like, extending diametrically across the interior of the pre-combustion chamber, or disposed at the axial center of the pre-combustion chamber, and extending throughout the axial or longitudinal extent thereof, which have been developed in accordance with the principles and teachings of the present invention;

FIG. 6 is a schematic elevational view of the new and improved combustion chamber system constructed in accordance with the principles and teachings of the present invention for use in connection with a combustion-powered, fastener-driving tool, wherein the combustion chamber system comprises a first pre-combustion chamber fluidically connected to a second final combustion chamber, and wherein further, a fourth embodiment of a combustion rate and flame jet propagation enhancement obstacle structure, in the form of a solid geometrical conical component, has been incorporated within the second or final combustion chamber so as to cause the division of the flame jet or flame front, coming into the second or final combustion chamber from the first or pre-combustion chamber, into a plurality of flame jet or flame front components, and the divergence of such flame jet or flame front components throughout the second or final combustion chamber, so as to achieve the complete and rapid combustion of the entire air-fuel mixture disposed within and throughout the second or final combustion chamber;

FIGS. 8*a*–8*f* are cross-sectional views, as taken along, for example, line 8—8 of FIG. 7*a*, showing different cross-sectional configurations which may be characteristic of or incorporated within any of the various obstacles, as disclosed within FIGS. 7*a*–7*h*, that can be utilized within the second final combustion chamber of the overall combustion-chamber system for use within the combustion-powered fastener-driving tool.

DETAILED DESCRIPTION OF THE PREFERRED EMBODIMENT

Figure 2:
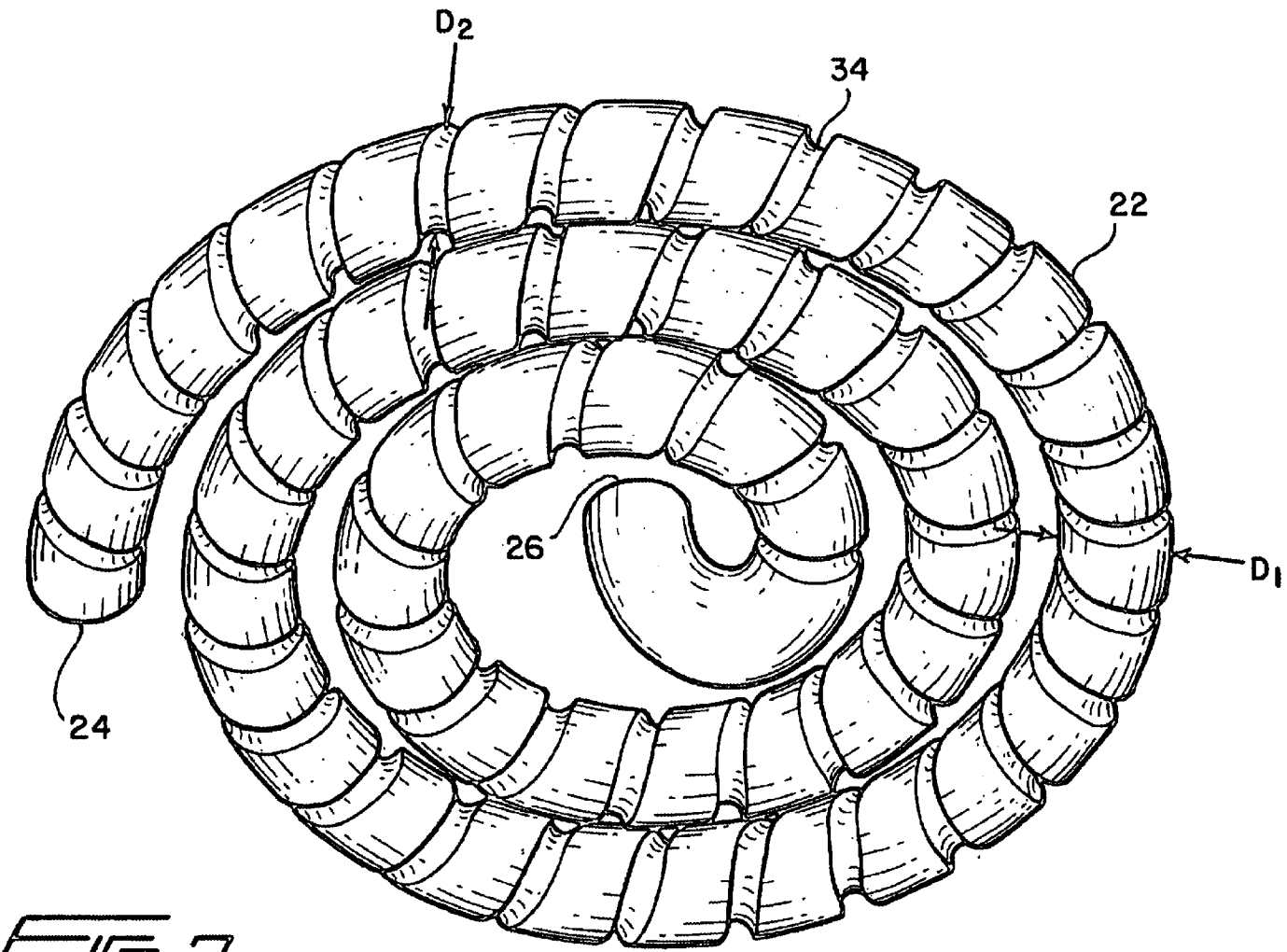
FIG. 2 is a perspective view of a core member which is used in connection with the molded fabrication of a pre-combustion chamber, for use as part of a dual combustion chamber system within a combustion-powered fastener-driving tool, wherein the pre-combustion chamber has structural features which have been uniquely developed in accordance with thee principles and teachings of the present invention.

As has been noted within the aforenoted United States Patent Application entitled COMBUSTION-CHAMBER SYSTEM WITH SPOOL-TYPE PRE-COMBUSTION CHAMBER, which was filed on Jan. 16, 2002 in the name of Donald L. Van Erden et al. and which has been assigned Ser. No. 10/050,836, the interests of compact mechanical design have resulted in PRIOR ART combustion systems, such as that disclosed within the aforenoted Ohtsu et al. patent, which have a relatively short axial length, and diameters or widths which are generally much greater than their lengths. However, experiments performed in connection with dual combustion chamber systems comprising first or pre-combustion chambers, which are characterized by relatively high length to width aspect ratios, and second or final combustion chambers, has revealed the fact that relatively high aspect ratio pre-combustion chambers are extremely effective at forcing unburned air-fuel mixtures ahead of an advancing flame or jet front into the second or final combustion chamber. In particular, the increased amount of fuel and air pumped into the final combustion chamber from an elongated pre-combustion chamber occurs in advance of a flame front proceeding from the ignition end of the pre-combustion chamber toward the discharge end of the pre-combustion chamber which communicates with the final combustion chamber. This structural arrangement increases the pressure within the final combustion chamber before ignition occurs there, and this, in turn, greatly increases the power which is obtainable or capable of being derived from the combustion occurring within the final combustion chamber. The improvement in power output from the final combustion chamber can be increased in ratios equal to low integer numbers simply by elongating the pre-combustion chamber wherein the same has an optimum aspect ratio. More particularly, in accordance with one of the principles and teachings of the present invention, combustion chamber systems with elongated linear pre-combustion chambers having length to width ratios over a broad range have been tested and it has been noted that a significant improvement in performance has been achieved when the aspect ratio is on the order of as little as 2:1. More enhanced performance levels have been achieved when the aspect ratio is within the range of 4:1 to 16:1, with peak performance being achieved when the aspect ratio is approximately 10:1. In addition, it has been noted that the pre-combustion chambers can comprise oval, round, rectangular, or other cross-sectional configurations whereby they will all function desirably well as long as the length dimension of the pre-combustion chamber is substantially greater than the average width dimension thereof.

It has also been determined that in addition to the elongated or linear pre-combustion chambers having the aforenoted geometrical configurations, the elongated pre-combustion chambers which are capable of generating substantially increased piston power output can be curved, or folded, in effect, back onto itself. Again, as long as the curved or folded pre-combustion chambers have relatively high aspect ratios, the aforenoted performance advantages will be able to be achieved. Still further, the pre-combustion chambers can be formed from or comprise curved sections that are joined in series, nested together, and/or combined with linear or straight combustion chambers, or combustion chamber sections so as to form compact assemblages which are capable of achieving the objective advantages of the present invention. It has been determined further that the output performance of the elongated pre-combustion chambers can also be influenced by means of aspect ratios concerning the width and thickness dimensions of the pre-combustion chambers. For example, an elongated pre-combustion chamber which has a rectangular cross-section and which would therefore be expected to exhibit enhanced output performance characteristics will fail to perform well if the aspect ratio of the width to thickness dimensions is relatively high. In other words, as the structure, shape, or configuration of an elongated pre-combustion chamber approaches that of a thin ribbon, it can become too constricted so as to quench a flame front so that it is not possible to propagate. More particularly, experiments have indicated that an optimal or desirable width to thickness aspect ratio for successfully operable elongated pre-combustion chambers is 4:1.

With the aforenoted discussion being considered, and continuing further as a result of reference being made to FIG. 6, the new and improved dual combustion chamber system, for use within combustion-powered fastener-driving tools, is disclosed and is generally indicated by the reference character 10. In particular, a first upper pre-combustion chamber is disclosed at 12, and a second lower final combustion chamber is disclosed 14. The downstream or exhaust end of the pre-combustion chamber 12 is fluidically connected to the upstream or intake end of the final combustion chamber 14 through means of a port 16 defined within a wall 17 effectively dividing the first pre-combustion chamber 12 from the second final combustion chamber 14, and the downstream or exhaust end of the final combustion chamber 14 is operatively associated with a working piston 18. The working piston 18 is disposed at a START position within a cylinder head 20 of a combustion-powered fastener-driving tool, and as is conventional, the cylinder head 20 forms an upstream portion of a cylinder housing, not shown, within which the working piston 18 is movably disposed. The working piston 18 is, in turn, operatively connected to a driver blade, also not shown, such that when the working piston 18 is moved downwardly within the cylinder housing under the influence of the expanding combustion conditions occurring within the final combustion chamber 14, the driver blade drives the leading one of the fasteners, as forwarded from the tool fastener magazine into the tool guide tube, not shown, through the guide tube and into the substrate or workpiece.

Figure 3:
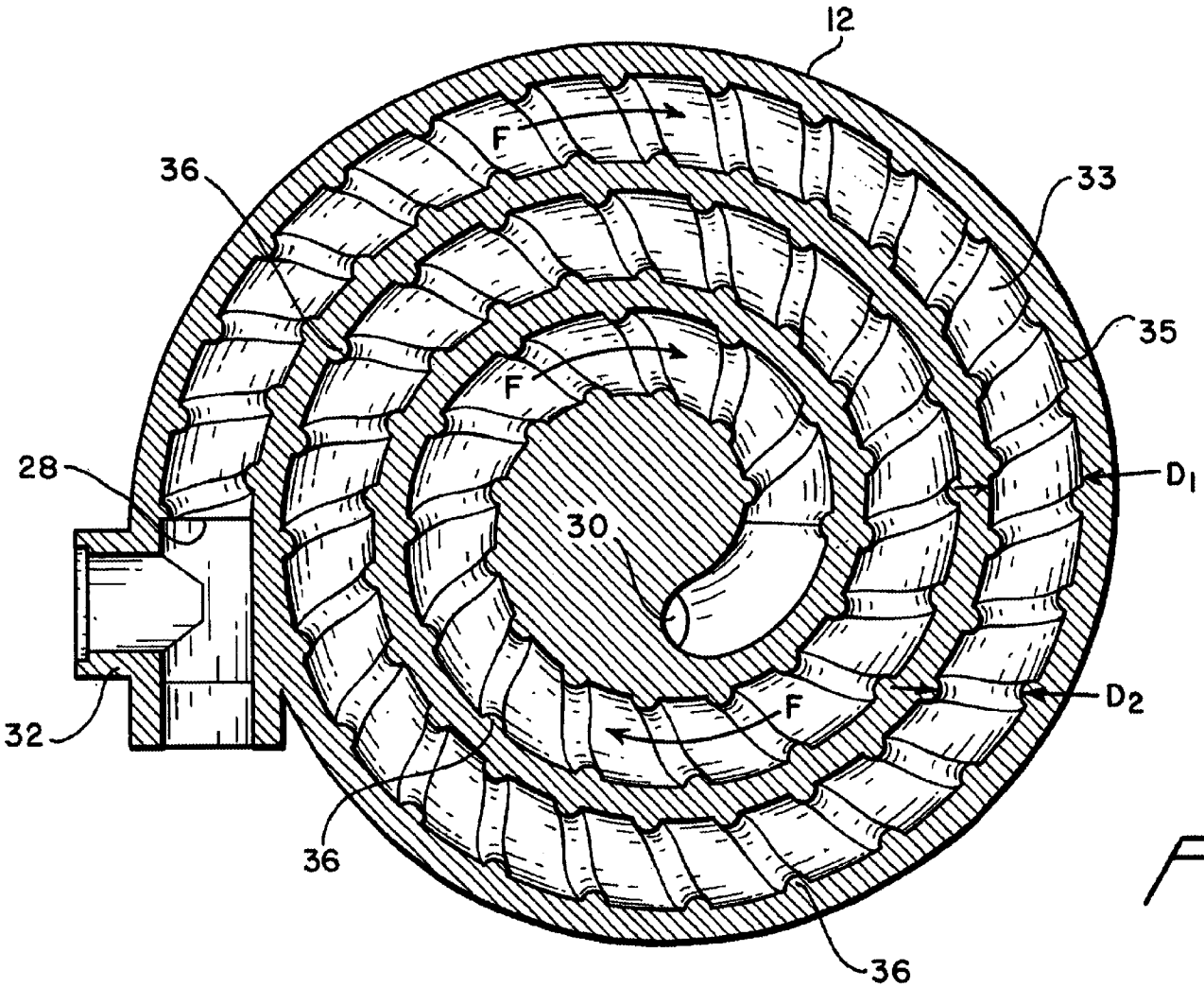
FIG. 3 is a top plan view of a pre-combustion chamber within which a first embodiment of a combustion rate and flame jet propagation enhancement obstacle structure in the form of a continuous spiral or helical rib or boss formed upon internal peripheral wall portions of the pre-combustion chamber and extending throughout the axial or longitudinal length thereof, has been incorporated in accordance with the principles and teachings of the present invention, wherein the pre-combustion chamber is fabricated from the mold core member illustrated within FIG. 2.

In order to fabricate the first pre-combustion chamber 12 in accordance with the principles and teachings of the present invention, a spiral, coil, or helical-shaped core member 22, as shown in FIG. 2, is utilized to mold or cast the pre-combustion chamber 12 which is shown in more detail in FIG. 3. More particularly, the core member 22 effectively comprises a male member around which the female pre-combustion chamber 12 is effectively molded or cast with the coiled portions thereof being substantially coplanar. As can be readily appreciated from FIG. 2, the male core member 22 has a radially outward upstream end portion 24 and a radially inward downstream end portion 26 which is disposed substantially at or adjacent to the axial center of the of the male core member 22. In this manner, when the female pre-combustion chamber 12 is fabricated in accordance with molding or casting techniques with respect to the male core member 22, the upstream end portion 24 of the male core member 22 effectively forms or defines an upstream intake or inlet end portion 28 within the female pre-combustion chamber 12, while the downstream end portion 26 of the male core member 22 likewise effectively forms or defines an outlet or exhaust end portion 30 which is adapted to be fluidically connected to the port 16 which fluidically interconnects the pre-combustion chamber 12 to the final combustion chamber 14 as illustrated within FIG. 6.

The upstream end portion of the pre-combustion chamber 12 additionally defines a housing portion 32 within which suitable ignition generator and spark plug components, not shown, may be housed for initiating combustion within the pre-combustion chamber 12, and it can be appreciated that upon initiation of combustion within the pre-combustion chamber 12, the flame front or jet will proceed along the longitudinally extending bore 33 defined within the coiled or spiraled pre-combustion chamber 12, and in the clockwise direction as denoted by means of the arrows F, so as to move from the upstream intake or inlet end portion 28 thereof toward the downstream outlet or exhaust end portion 30 thereof. As a result of the coiled or spiraled configuration of the pre-combustion chamber 12, it can be appreciated that in accordance with one of the unique and novel structural characteristics of the present invention, the structure of the pre-combustion chamber 12 is quite compact, and yet, in accordance with another one of the unique and novel structural characteristics of the present invention, the aspect ratio of the longitudinal length dimension of the pre-combustion chamber 12 as compared to the width dimension or diametrical extent of the pre-combustion chamber 12 is on the order of, for example, 30:1.

In accordance with still another unique and novel structural characteristic of the present invention, and with reference still being made to FIGS. 2 and 3, it is seen that the male core member 22 comprises a rod or tubular member wherein the outer peripheral wall portion has a predetermined outer peripheral diametrical extent $D_1$, and formed within the outer peripheral wall portion of the core member 22 there is provided a continuous spiral or helical-shaped groove 34 wherein the groove 34 has a predetermined diametrical extent $D_2$ which is less than the diametrical extent $D_1$ of the outer peripheral wall portion. Accordingly, when the male core member 22 is used to fabricate the pre-combustion chamber 12 by means of suitable molding or casting techniques, it can be readily appreciated from FIG. 3 that the interior peripheral wall portion 35 of the pre-combustion chamber 12, which defines the bore 33 of the pre-combustion chamber 12, has a diametrical extent which is substantially the same as the external diametrical extent $D_1$ of the male core member 22. In addition, it is noted that the inner peripheral wall portion or bore 33 of the pre-combustion chamber 12 is provided with a continuous spiral or helical-shaped rib or boss member 36 wherein individual portions of the continuous spiral or helical-shaped rib or boss member 36 are effectively formed or disposed at a plurality of positions which are axially spaced along the longitudinal extent of the bore 33 of the pre-combustion chamber 12 so as together effectively form the continuous spiral-shaped boss or rib member 36 which has an inner diametrical extent $D_2$ which corresponds substantially to the outer or external diametrical extent $D_2$ of the continuous spiral or helical-shaped grooved region 34 of the male core member 22.

The purpose of providing the continuous spiral or helical-shaped annular rib or boss member 36 upon the internal peripheral wall portion 35 of the pre-combustion chamber 12 so as to extend throughout the longitudinal extent of the pre-combustion chamber 12 is that it has been discovered that the formation, location, or placement of such rib or boss member 36, within the vicinity of or adjacent to the interior peripheral wall portion 35 of the pre-combustion chamber 12, dramatically enhances the rate of burn of the air-fuel mixture disposed within the pre-combustion chamber 12 as well as the speed at which the flame jet or flame front travels or propagates axially or longitudinally downstream within the pre-combustion chamber 12. In a similar manner, and as can best be appreciated from FIG. 4, in lieu of the continuous spiral-shaped rib or boss member 36 being formed upon the internal peripheral wall portion 35 of the pre-combustion 12, a plurality of separate washer members can be fixedly disposed upon the internal peripheral wall portion 35 of the pre-combustion chamber 12 at axially or longitudinally spaced positions throughout the longitudinal extent of the pre-combustion chamber 12, a plurality of such washer members being disclosed, for example, at 38–46 along only a limited axially or longitudinally extending portion of the pre-combustion chamber 12. The disposition or use of such plurality of axially or longitudinally spaced washer members achieves substantially the same effect as the use of the continuous spiral-shaped rib or boss member 36 in that the placement or disposition of such annular washer members within the vicinity of or adjacent to the interior peripheral wall portion 35 of the pre-combustion chamber 12 likewise dramatically enhances the rate of burn of the air-fuel mixture disposed within the pre-combustion chamber 12 as well as the speed at which the flame jet or flame front travels or propagates axially or longitudinally downstream within the pre-combustion chamber 12.

Still yet further, in lieu of the individual annular washer members, such as, for example, the washer members 38–46 schematically illustrated in FIG. 4, half-washer members may be fixed upon diametrically opposite internal peripheral wall portions of the pre-combustion chamber 12 and at alternative positions along the axial or longitudinal extent of the pre-combustion chamber 12. More particularly, for example, in lieu of completely annular washer member 38, only a half-washer or semi-circular washer member 38' may be fixedly disposed at the particularly noted axial position and upon an upper internal peripheral wall portion of the pre-combustion chamber 12 as illustrated in FIG. 4, and in conjunction with half-washer or semi-circular washer member 38', additional half-washer or semi-circular washer members 40', 42', 44', 46' may be fixedly disposed upon lower and upper internal peripheral wall portions, respectively, of the pre-combustion chamber 12. In this manner, it can be appreciated that, in effect, a substantially spiral-shaped convex structure, somewhat similar to the continuous spiral-shaped rib or boss member 36 as illustrated in FIG. 3, is formed so as to likewise dramatically enhance the rate of burn of the air-fuel mixture disposed within the pre-combustion chamber 12 as well as the speed at which the flame jet or flame front travels or propagates axially or longitudinally downstream within the pre-combustion chamber 12.

With reference now being made to FIG. 5, structure may likewise be incorporated within the pre-combustion chamber 35 so as to affect the rate of burn of the air-fuel mixture disposed within the pre-combustion chamber 12, as well as the speed at which the flame jet or flame front travels or propagates axially or longitudinally downstream within the pre-combustion chamber 12, in a manner which is effectively converse to the results achieved by means of the aforenoted provision of the continuous spiral-shaped rib or boss member 36 in conjunction with the internal peripheral wall portion 35 of the pre-combustion chamber 12 as illustrated within FIG. 3, or to the results achieved by means of the aforenoted provision of the annular or semi-circular washer members 38–46, 38'–46' in conjunction with the internal peripheral wall portion 35 of the pre-combustion chamber 12 as is also illustrated within FIG. 4. More particularly, a plurality of pins 48 are fixedly mounted within axially spaced side wall portions of the pre-combustion chamber 12 so as to extend transversely or diametrically across the pre-combustion chamber 12 in such a manner as to have an orientation which is substantially perpendicular to the longitudinal axis of the pre-combustion chamber 12 and the direction F of movement or propagation of the flame front or jet.

In lieu of, or in conjunction with, the provision of the plurality of transversely oriented pins 48 pins within the pre-combustion chamber 12, a plurality of spheres, orbs, discs, or plates 50 may likewise be disposed within the pre-combustion chamber 12 at axially spaced positions disposed along the longitudinal axis or axially central position of the bore 33 of the pre-combustion chamber 12. As a result of the noted disposition and orientation of the plurality of pins 48 or spheres, orbs, discs, or plates 50 within the pre-combustion chamber 12, it has been discovered or noted that the rate of burn of the air-fuel mixture disposed within the pre-combustion chamber 12, as well as the speed at which the flame jet or flame front travels or propagates axially or longitudinally downstream within the pre-combustion chamber 12, can be retarded.

Accordingly, by selectively choosing the number of pins 48 and spheres, orbs, discs, or plates 50 disposed within the pre-combustion chamber 12, as well as the particular axial positions at which the pins 48 and spheres, orbs, discs, or plates 50 are disposed within the pre-combustion chamber 12, different degrees of retardation of the rate of burn of the air-fuel mixture within the pre-combustion chamber 12, as well as the speed at which the flame jet or flame front travels or propagates axially or longitudinally downstream within the pre-combustion chamber 12, can be achieved. Still further, it can readily be appreciated that in accordance with the principles and teachings of the present invention, the rate of burn and propagation speed retardation structures 48, 50, as illustrated within FIG. 5, can be structurally combined with the rate of burn and propagation speed enhancement structures 36 and 38–46, 38'–46', as respectively illustrated within FIGS. 3 and 4, so as to optimally control the air-fuel mixture rate of burn and the flame jet or flame front propagation speed characteristics of the pre-combustion chamber 12. It is critically important to ensure that the flame front or flame jet propagation speed is high enough such that when the flame front or flame jet enters the final combustion chamber 14, ignition within the final combustion chamber 14 occur in an optimum fashion.

With reference now being made to FIG. 6, the details of the various structural components comprising the final combustion chamber 14, in order to enhance or advantageously affect the complete and rapid combustion of the air-fuel mixture disposed within the final combustion chamber 14, as well as the propagation speed of the flame front or flame jet, are disclosed. More particularly, as has been noted hereinbefore, as a result of the ignition of a portion of the air-fuel mixture within the pre-combustion chamber 12, a flame front or flame jet propagates through the pre-combustion chamber 12 and effectively pushes a residual portion of the air-fuel mixture ahead of the flame front or flame jet such that the residual air-fuel mixture and the flame front or flame jet passes through the port 16 and enters the final combustion chamber 14. In accordance with the unique and novel principles and teachings of the present invention, and in order to enhance or advantageously affect the complete and rapid combustion of the air-fuel mixture within the final combustion chamber 14, as well as the propagation speed of the flame front or flame jet, an obstacle 52 is fixedly incorporated within the final combustion chamber 14 so as to be disposed within the vicinity of or adjacent to the port 16.

More particularly, the obstacle 52 comprises a solid or three-dimensional geometrical figure which, as an example, comprises that of a cone with the apex portion 54 thereof facing or disposed adjacent to the port 16. In this manner, as the incoming air-fuel mixture and flame front or flame jet enter the final combustion chamber 14 from the pre-combustion chamber 12, the air-fuel mixture and flame front or flame jet will encounter the apex portion 54 of the conical obstacle 52 whereby the air-fuel mixture and flame front or flame jet will effectively be divided into a multiplicity of flows schematically illustrated as $F_1$ and $F_2$. It will of course be appreciated that in reality, the original air-fuel mixture and flame front or flame jet will effectively be divided into numerous flows, more than merely the schematically illustrated flows $F_1$ and $F_2$, due to the three-dimensional nature of the final combustion chamber 14 and obstacle 52. In addition, it is further appreciated that the upstream wall portions 56, partially defining the final combustion chamber 14, diverge radially outwardly from the port 16, and substantially correspond geometrically with the geometrical configuration of the obstacle 52, so as to operatively cooperate with the conical surface portion of the conically configured obstacle 52 in effectively defining the flow channels 58 within which the various fluid flows $F_1$ and $F_2$ can be conducted in their aforenoted radially divergent manner. Accordingly, the flow channels 58 are fluidically somewhat similar to the flow channel defined within the bore 33 of the pre-combustion chamber 12 in that the fluid flow through the channels 58 is enhanced or accelerated.

More particularly, as the flame front or flame jet traverses or flows downstream from port 16 toward working piston 18, the flame front or flame jet tends to adhere to or stay within the vicinity of the internal surface portions of both the upstream wall portions 56 of the final combustion chamber 14 and the obstacle 52, as a result of well known boundary surface conditions or properties, so as to effectively comprise an annular flame front or flame jet which continually expands radially outwardly. In this manner, the expanding flame front or flame jet effectively engulfs or contacts the unburned air-fuel mixture throughout the final combustion chamber 14 so as to in fact ignite the same. It is further noted that downstream wall portions 60 of the final combustion chamber 14 converge toward each other so as to effectively conduct and deflect the combustion-generated pressure forces, power, and energy, developed within the final combustion chamber 14, toward the working piston 18 so as to impact the same with the desired requisite amount of working energy and power. It is to be appreciated that as a result of the use, disposition, and presence of the conically shaped obstacle 52 within the upstream end of the final combustion chamber 14, and furthermore, as a result of the use, disposition, and presence of the conically shaped obstacle 52 in combination with the obliquely oriented or divergent upstream wall portions 56 of the final combustion chamber 14, the flame front or flame jet is able to fully encompass the entire width or diametrical expanse of the final combustion chamber 14 so as to achieve the two critically important features or characteristics of the combustion within the final combustion chamber 14, that is, complete combustion of the air-fuel mixture present within the final combustion chamber 14, and the combustion of the same with the requisite amount or proper rate of speed.

It is to be particularly noted, for example, that if the speed of the flame front or flame jet within the final combustion chamber 14 is too slow, partial combustion of the air-fuel mixture within the final combustion chamber will effectively occur so as to initialize movement of the working piston prior to the combustion process developing the peak power and energy for impacting upon the working piston in order to derive peak power output in connection with the driving of the fasteners through and out of the tool 10. On the other hand, if the speed of the flame front or flame jet within the combustion chamber 14 is too fast so as to complete its passage through the final combustion chamber 14 without completely igniting the entire air-fuel mixture within the final combustion chamber, then, again, peak power and energy output cannot be derived from the combustion process, and in addition, the flame front or flame jet will be disadvantageously reflected, by means of the working piston 18, back into the final combustion chamber 14 toward the port 16. This is not at all desirable in that it would deleteriously affect combustion conditions within the final combustion chamber 14, as well as negatively affect the transmission of the pressure forces, power, and energy, developed within the final combustion chamber 14, toward the working piston 18 whereby, in turn, adverse operational effects in connection with the driving of the fasteners would correspondingly result.

Figures 7A, 7B, 7C, 7D, 7E, 7F, 7G, 7H:
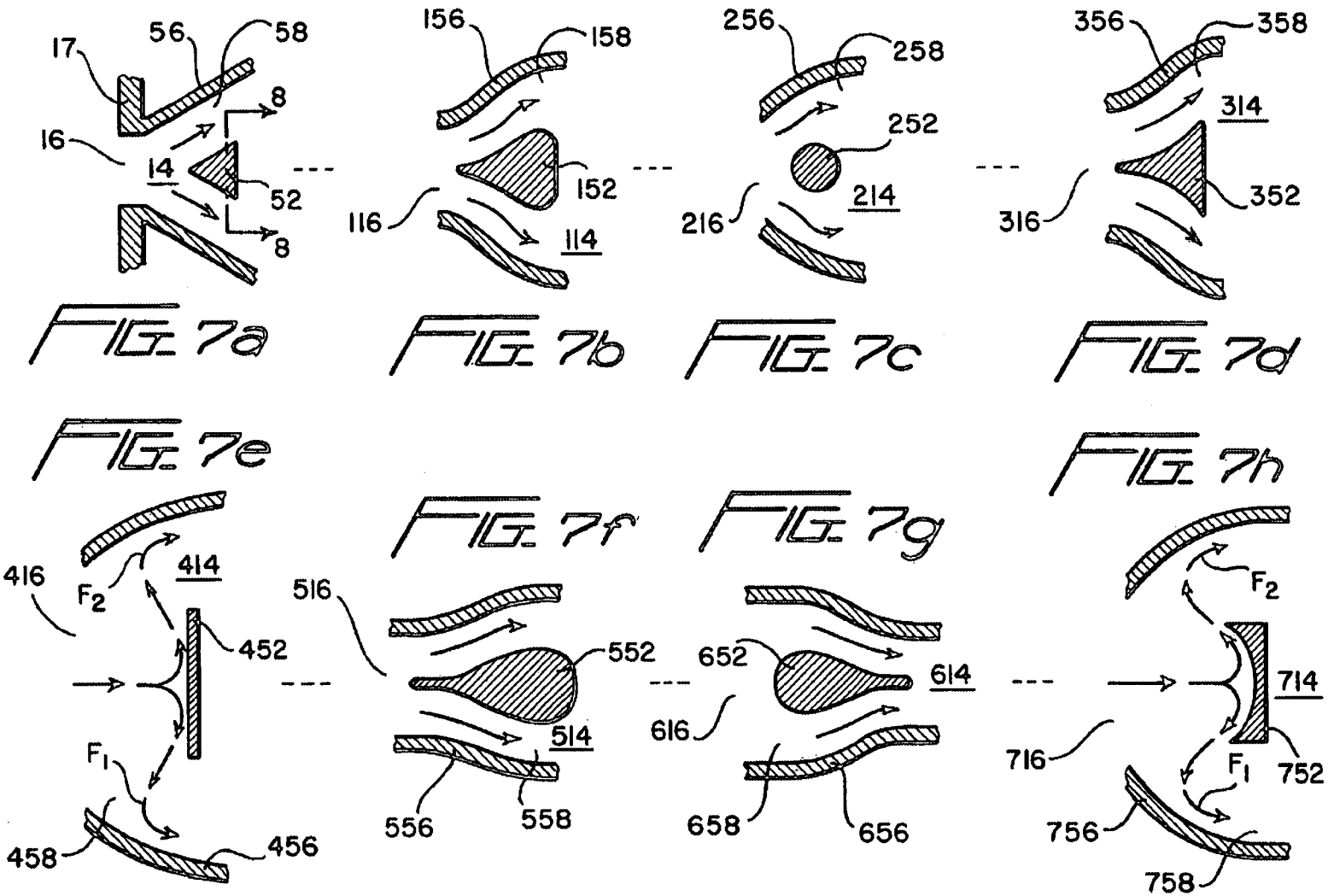
FIGS. 7*a*–7*h* are schematic views showing differently configured obstacles that can be disposed and utilized within the second final combustion chamber in order to achieve the complete and rapid ignition of all regions of the unburned air-fuel mixture present within the final combustion chamber so as to in turn develop peak energy and power characteristics for acting upon the working piston-driver assembly.

With reference now being made to FIGS. 7*a*–7*h*, FIG. 7*a* corresponds substantially to FIG. 6 in that FIG. 7*a* discloses the use of a conically configured obstacle 52 within the upstream end portion of the second final combustion chamber 14, and it is particularly noted, for the instructional or disclosure purposes of FIGS. 7*a*–7*h*, that in order to properly or optimally define the flow channels 58 and the fluid flows $F_1$ and $F_2$ therethrough as has been previously discussed, it is seen that the wall portions 56 have structural configurations or contours which substantially correspond to those of the side wall portions of the conically configured obstacle 52. Furthermore, in accordance with the principles and teachings of the present invention, obstacles, having geometrical configurations which are different from the conical configuration of the obstacle 52, may be utilized within the second final combustion chamber 14. More particularly, FIG. 7*b* discloses an obstacle 152 which has a substantially conical configuration, however, it is noted that in lieu of the conical obstacle 152 having side wall portions which are linear, the upstream side wall portions of the obstacle 152 are substantially concavely curved while the downstream side wall portions of the obstacle 152 are convexly curved. Correspondingly, it is noted that the wall members 156 partially defining the final combustion chamber 114 have configurations or contours which effectively match those of the side wall portions of the obstacle 152 so as to structurally cooperate with the side wall portions of the obstacle 152 so as to properly or optimally define or form the flow channels 158.

Continuing further, FIG. 7*c* illustrates an obstacle 252 which has a substantially spherical configuration, and correspondingly, final combustion chamber upstream wall portions 256, partially defining the final combustion chamber 214, have configurations or contours which effectively match those of the side wall portions of the spherical obstacle 252 so as to structurally cooperate with the side wall portions of the obstacle 252 in properly or optimally defining or forming the flow channels 258. Similarly, with reference being made to FIG. 7*d*, there is illustrated an obstacle 352 which has a substantially conical configuration, except that in lieu of the side wall portions being linear, the side wall portions of the obstacle 352 are concavely curved. Correspondingly, final combustion chamber upstream wall portions 356, partially defining the final combustion chamber 314, have configurations or contours which effectively match those of the side wall portions of the conical obstacle 352 so as to structurally cooperate with the side wall portions of the obstacle 352 in properly or optimally defining or forming the flow channels 358.

Still further, as illustrated within FIG. 7*e*, an obstacle 452 having a configuration which is substantially that of a flat plate may be utilized within the final combustion chamber 414, while as disclosed within FIG. 7*f*, an obstacle 552 is disclosed as having a substantially teardrop configuration. Correspondingly, final combustion chamber upstream wall portions 556, partially defining the final combustion chamber 514, have configurations or contours which effectively match those of the side wall portions of the tear-drop obstacle 552 so as to structurally cooperate with the side wall portions of the obstacle 552 in properly or optimally defining or forming the flow channels 558. FIG. 7*g* discloses an obstacle 652 which is substantially the same as the tear-drop obstacle 552 as disclosed within FIG. 7*f* in that the same has a substantially tear-drop shape or configuration, however, the longitudinal orientation of the tear-drop obstacle 652 is effectively reversed with respect to the orientation of the tear-drop obstacle 552 as disclosed within FIG. 7*f*. Accordingly, it can further be appreciated that final combustion chamber upstream wall portions 656, partially defining the final combustion chamber 614, have configurations or contours which likewise effectively match those of the side wall portions of the tear-drop obstacle 652 so as to structurally cooperate with the side wall portions of the obstacle 652 in properly or optimally defining or forming the flow channels 658 in a manner similar to, but reversed from, that of the obstacle system shown in FIG. 7*f*. Lastly, as disclosed within FIG. 7*h*, an obstacle 752 having a configuration substantially similar to that of the flat plate 452 of FIG. 7*e*, except that the upstream face of the obstacle 752 disposed toward the port 716 has a concave or crescent-shaped configuration, may likewise be used within the final combustion chamber 714.

It is further noted that, in conjunction with both the flat plate and crescent-shaped obstacles 452, 752, such obstacles 452, 752 are optimally located further downstream or away from the ports 416, 716, than the corresponding disposition of the obstacles 52, 152, 252, 352, 552, 652 relative to the ports 16, 116, 216, 316, 516, 616 as respectively disclosed within FIGS. 7*a*–7*d*, 7*f*, and 7*g*, in order to effectively prevent undesirable rebound of the incoming flame fronts back toward the ports 416, 716, and to correspondingly permit the divided fluid flows $F_1$ and $F_2$ to flow radially outwardly toward the upstream final combustion side walls 456 and 756. It is further accordingly seen that the final combustion chamber upstream side wall portions 456, 756, partially defining the respective final combustion chambers 414, 714, have configurations or contours which, while obviously not actually matching the configurations or contours of the obstacles 452, 752, nevertheless effectively facilitate or promote the fluid flows $F_1$ and $F_2$ within the flow channels 458, 758.

With reference lastly being made to FIGS. 8*a*–8*f*, while the obstacle 52, as disclosed within FIG. 7*a*, may comprise, as has been previously disclosed, a true geometrical cone such that the cross-sectional configuration thereof as taken along the line 8—8 of FIG. 7*a* is that of a circle 852*a* as disclosed within FIG. 8*a*, obstacles, while retaining an axial cross-sectional configuration which would be similar to that of the cone 52, may be alternatively configured such that the transverse cross-sectional configurations thereof are no longer circular nad may comprise other geometrical configurations. More particularly, an obstacle similar to that of obstacle 52 may alternatively have transverse cross-sectional configurations which selectively comprise, for example, a pentagon as shown at 852*b* in FIG. 8*b*, a rectangle as shown at 852*c* in FIG. 8*c*, a cross or X as shown at 852*d* in FIG. 8*d*, a circle having diametrical extensions as shown at 852*e* in FIG. 8*e*, and a suitable irregular polygon as shown at 852*f* in FIG. 8*f*.

Thus, it may be seen that in accordance with the teachings and principles of the present invention, there has been disclosed a new and improved combustion chamber system for use within a combustion-powered fastener-driving tool, and a new and improved combustion-powered fastener-driving tool having the new and improved combustion chamber system incorporated therein, wherein the combustion chamber system comprises, for example, a dual combustion chamber system comprising a first, upstream pre-combustion chamber and a second, downstream final combustion chamber, wherein the first, upstream pre-combustion chamber is characterized by means of a high aspect ratio, and wherein the pre-combustion chamber has predeterminedly different obstacles fixedly incorporated therein for either selectively retarding or enhancing the rate of burn and the rate of speed of the flame jet or flame front propagating through such pre-combustion chamber. In a similar manner, an obstacle having a predetermined three-dimensional or solid geometrical configuration is disposed within the second, downstream final combustion chamber at a position immediately disposed downstream of the port fluidically interconnecting the first upstream pre-combustion chamber to the second downstream final combustion chamber.

In this manner, as the flame jet or flame front enters the final combustion chamber, the flame jet or flame front effectively diverges and is split into multiple sections or components which flow radially outwardly toward the walls of the final combustion chamber, and which therefore traverse the entire diametrical extent of the final combustion chamber so as to thereby completely and rapidly ignite all regions of the unburned air-fuel mixture present within the final combustion chamber. The flame jet or flame front eventually encounters the working piston, by which time the pressure forces developed as a result of the rapid but controlled combustion within the final combustion chamber can effectively act upon the working piston so as to cause movement of the piston-driver assembly with the desired peak energy and power so as to in turn cause the particular fastener disposed within the guide tube of the tool to be discharged and driven into the particular substrate or workpiece.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by letter patent of the united states of america, is:

1. A combustion chamber system, for use within combustion-powered fastener-driving tools, comprising:

a pre-combustion chamber having an aspect ratio, defined by means of the ratio of the length dimension of said pre-combustion chamber relative to the width dimension of said pre-combustion chamber, which is at least 2:1;

means defined within an upstream end portion of said pre-combustion chamber for initiating combustion of an air-fuel mixture which propagates through said pre-combustion chamber, from said upstream end portion of said pre-combustion chamber to a downstream end portion of said pre-combustion chamber, by means of a flame front;

a final combustion chamber fluidically connected by a port to said downstream end portion of said pre-combustion chamber and having a working piston operatively disposed at a downstream end portion of said final combustion chamber for driving fasteners out from the tool and into a substrate; and first obstacle means disposed within said pre-combustion chamber for selectively enhancing and retarding the rate of burn of said air-fuel mixture within said pre-combustion chamber, and the speed at which said flame front propagates through said pre-combustion chamber.

2. The system as set forth in claim 1, further comprising:

second obstacle means disposed within said final combustion chamber for ensuring the rapid and complete combustion of said air-fuel mixture within said final combustion chamber such that peak energy and power can be impressed upon said working piston for driving from the tool and into a substrate.

3. The system as set forth in claim 2, wherein said second obstacle means disposed within said final combustion chamber for ensuring the rapid and complete combustion of said air-fuel mixture within said final combustion chamber comprises:

a solid geometrical figure disposed within an up-stream end portion of said final combustion chamber and adjacent to said port fluidically interconnecting said pre-combustion chamber to said final combustion chamber for encountering said flame front propagating from said pre-combustion chamber into said final combustion chamber and for splitting said propagating flame front into radially divergent flame front portions for combustibly igniting all regions of said air-fuel mixture disposed within said final combustion chamber.

4. The system as set forth in claim 3, wherein:

said solid geometrical figure comprises a cone wherein an apex portion of said cone faces said port fluidically interconnecting said pre-combustion chamber to said final combustion chamber.

5. The system as set forth in claim 3, wherein:

said solid geometrical figure is selected from the group comprising a cone, a sphere, a plate, and a tear-drop.

6. The system as set forth in claim 3, wherein:

said solid geometrical figure has a transverse cross-sectional configuration which is selected from the group comprising a circle, a pentagon, a rectangle, a cross, and an irregular polygon.

7. The system as set forth in claim 4, further comprising:

divergent wall portions partially defining said final combustion chamber and operatively cooperating with said solid geometrical conical figure for defining annular flow channel portions within which said split radially divergent flame front portions can propagate with an enhanced rate of speed so as to achieve said combustible ignition of all regions of said air-fuel mixture disposed within said final combustion chamber while developing said peak energy and power for impression upon said working piston for driving the fasteners from the tool and into a substrate.

8. The system as set forth in claim 5, wherein:

when said solid geometrical figure comprises one of said cone, sphere, and tear-drop figures, wall portions, partially defining said final combustion chamber, have geometrical configurations which substantially correspond to the contours of side wall portions of said one of said cone, sphere, and tear-drop figures so as to operatively cooperate with said solid geometrical figure for defining annular flow channel portions within which said split radially divergent flame front portions can propagate with an enhanced rate of speed so as to achieve said combustible ignition of all regions of said air-fuel mixture disposed within said final combustion chamber while developing said peak energy and power for impression upon said working piston for driving the fasteners from the tool and into a substrate.

9. The system as set forth in claim 7, further comprising:

convergent wall portions partially defining said final combustion chamber and disposed downstream from said divergent wall portions partially defining said final combustion chamber for deflecting combustion-generated pressure forces, power, and energy, developed within said final combustion chamber, toward said working piston so as to impact and move said working piston for driving the fasteners from the tool and into a substrate.

10. The system as set forth in claim 1, wherein:

said pre-combustion chamber has a coiled configuration wherein coiled portions of said pre-combustion chamber are substantially coplanar with respect to each other; and said aspect ratio is 30:1.

11. The system as set forth in claim 1, wherein:

said first obstacle means disposed within said pre-combustion chamber, for enhancing said rate of burn of said air-fuel mixture within said precombustion chamber, and said speed at which said flame front propagates through said pre-combustion chamber, comprises obstacle means located within the vicinity of inner peripheral wall portions of said pre-combustion chamber and extending substantially from said up-stream end portion of said pre-combustion chamber to said downstream end portion of said pre-combustion chamber.

12. The system as set forth in claim 11, wherein:

said first obstacle means disposed within said pre-combustion chamber, for enhancing said rate of burn of said air-fuel mixture within said pre-combustion chamber, and said speed at which said flame front propagates through said pre-combustion chamber, comprises a continuous spiral-shaped rib member formed upon an internal peripheral wall surface portion of said pre-combustion chamber and extending substantially from said upstream end portion of said pre-combustion chamber to said downstream end portion of said pre-combustion chamber.

13. The system as set forth in claim 11, wherein:

said first obstacle means disposed within said pre-combustion chamber, for enhancing said rate of burn of said air-fuel mixture within said pre-combustion chamber, and said speed at which said flame front propagates through said pre-combustion chamber, comprises a plurality of annular washers disposed at axially spaced positions located along the longitudinal extent of said pre-combustion chamber which extends substantially from said upstream end portion of said pre-combustion chamber to said downstream end portion of said pre-combustion chamber.

14. The system as set forth in claim 11, wherein:

said first obstacle means disposed within said pre-combustion chamber, for enhancing said rate of burn of said air-fuel mixture within said pre-combustion chamber, and said speed at which said flame front propagates through said pre-combustion chamber, comprises a plurality of semi-circular washers disposed upon diametrically opposite side wall portions of said pre-combustion chamber and at alternative axially spaced positions located along the longitudinal extent of said pre-combustion chamber which extends substantially from said upstream end portion of said pre-combustion chamber to said downstream end portion of said pre-combustion chamber.

15. The system as set forth in claim 1, wherein:

said first obstacle means disposed within said pre-combustion chamber, for retarding said rate of burn of said air-fuel mixture within said pre-combustion chamber, and said speed at which said flame front propagates through said pre-combustion chamber, comprises obstacle means located along the longitudinal axis of said pre-combustion chamber and extending substantially from said upstream end portion of said pre-combustion chamber to said downstream end portion of said pre-combustion chamber.

16. The system as set forth in claim 15, wherein:

said first obstacle means disposed within said pre-combustion chamber, for retarding said rate of burn of said air-fuel mixture within said pre-combustion chamber, and said speed at which said flame front propagates through said pre-combustion chamber, comprises a plurality of pins extending transversely through side wall portions of said pre-combustion chamber so as to be oriented substantially perpendicular to the flow of said flame front through said pre-combustion chamber and disposed at axially spaced positions located along the longitudinal extent of said pre-combustion chamber extending from said upstream end portion of said pre-combustion chamber to said downstream end portion of said pre-combustion chamber.

17. The system as set forth in claim 15, wherein:

said first obstacle means disposed within said pre-combustion chamber, for retarding said rate of burn of said air-fuel mixture within said pre-combustion chamber, and said speed at which said flame front propagates through said pre-combustion chamber, comprises a plurality of axially spaced orbs disposed along the central longitudinal axis of said pre-combustion chamber extending from said upstream end portion of said pre-combustion chamber to said downstream end portion of said pre-combustion chamber.

18. The system as set forth in claim 15, wherein:

said first obstacle means disposed within said pre-combustion chamber, for retarding said rate of burn of said air-fuel mixture within said pre-combustion chamber, and said speed at which said flame front propagates through said pre-combustion chamber, comprises a plurality of axially spaced plates disposed along the central longitudinal axis of said pre-combustion chamber extending from said upstream end portion of said pre-combustion chamber to said downstream end portion of said pre-combustion chamber.

19. The system as set forth in claim 15, wherein:

said first obstacle means disposed within said pre-combustion chamber, for retarding said rate of burn of said air-fuel mixture within said pre-combustion chamber, and said speed at which said flame front propagates through said pre-combustion chamber, comprises a plurality of axially spaced discs disposed along the central longitudinal axis of said pre-combustion chamber extending from said upstream end portion of said pre-combustion chamber to said downstream end portion of said pre-combustion chamber.

20. A combustion-powered fastener-driving tool for driving fasteners into substrates, comprising:

a working piston for driving fasteners out from said tool and into a substrate;

a pre-combustion chamber having an aspect ratio, defined by means of the ratio of the length dimension of said pre-combustion chamber relative to the width dimension of said pre-combustion chamber, which is at least 2:1;

means defined within an upstream end portion of said pre-combustion chamber for initiating combustion of an air-fuel mixture which propagates through said pre-combustion chamber, from said upstream end portion of said pre-combustion chamber to a downstream end portion of said pre-combustion chamber, by means of a flame front;

a final combustion chamber fluidically connected by a port to said downstream end portion of said pre-combustion chamber and having said working piston operatively disposed at a downstream end portion of said final combustion chamber for driving the fasteners out from said tool and into the substrate; and first obstacle means disposed within said pre-combustion chamber for selectively enhancing and retarding the rate of burn of said air-fuel mixture within said pre-combustion chamber, and the speed at which said flame front propagates through said pre-combustion chamber.

21. The tool as set forth in claim 20, wherein:

said pre-combustion chamber has a coiled configuration wherein coiled portions of said pre-combustion chamber are substantially coplanar with respect to each other; and said aspect ratio is 30:1.

22. The tool as set forth in claim 20, wherein:

said first obstacle means disposed within said pre-combustion chamber, for enhancing said rate of burn of said air-fuel mixture within said pre-combustion chamber, and said speed at which said flame front propagates through said pre-combustion chamber, comprises obstacle means located within the vicinity of inner peripheral wall portions of said pre-combustion chamber and extending substantially from said up-stream end portion of said pre-combustion chamber to said downstream end portion of said pre-combustion chamber.

23. The tool as set forth in claim 22, wherein:

said first obstacle means disposed within said pre-combustion chamber, for enhancing said rate of burn of said air-fuel mixture within said pre-combustion chamber, and said speed at which said flame front propagates through said pre-combustion chamber, comprises a continuous spiral-shaped rib member formed upon an internal peripheral wall surface portion of said pre-combustion chamber and extending substantially from said upstream end portion of said pre-combustion chamber to said downstream end portion of said pre-combustion chamber.

24. The tool as set forth in claim 22, wherein:

said first obstacle means disposed within said pre-combustion chamber, for enhancing said rate of burn of said air-fuel mixture within said pre-combustion chamber, and said speed at which said flame front propagates through said pre-combustion chamber, comprises a plurality of annular washers disposed at axially spaced positions located along the longitudinal extent of said pre-combustion chamber which extends substantially from said upstream end portion of said pre-combustion chamber to said downstream end portion of said pre-combustion chamber.

25. The tool as set forth in claim 22, wherein:

said first obstacle means disposed within said pre-combustion chamber, for enhancing said rate of burn of said air-fuel mixture within said pre-combustion chamber, and said speed at which said flame front propagates through said pre-combustion chamber, comprises a plurality of semi-circular washers disposed upon diametrically opposite side wall portions of said pre-combustion chamber and at alternative axially spaced positions located along the longitudinal extent of said pre-combustion chamber which extends substantially from said upstream end portion of said pre-combustion chamber to said downstream end portion of said pre-combustion chamber.

26. The tool as set forth in claim 20, wherein:

said first obstacle means disposed within said pre-combustion chamber, for retarding said rate of burn of said air-fuel mixture within said pre-combustion chamber, and said speed at which said flame front propagates through said pre-combustion chamber, comprises obstacle means located along the longitudinal axis of said pre-combustion chamber and extending substantially from said upstream end portion of said pre-combustion chamber to said downstream end portion of said pre-combustion ion chamber.

27. The tool as set forth in claim 26, wherein:

said first obstacle means disposed within said pre-combustion chamber, for retarding said rate of burn of said air-fuel mixture within said pre-combustion chamber, and said speed at which said flame front propagates through said pre-combustion chamber, comprises a plurality of pins extending transversely through side wall portions of said pre-combustion chamber so as to be oriented substantially perpendicular to the flow of said flame front through said pre-combustion chamber and disposed at axially spaced positions located along the longitudinal extent of said pre-combustion chamber extending from said upstream end portion of said pre-combustion chamber to said downstream end portion of said pre-combustion chamber.

28. The tool as set forth in claim 26, wherein:

said first obstacle means disposed within said pre-combustion chamber, for retarding said rate of burn of said air-fuel mixture within said pre-combustion chamber, and said speed at which said flame front propagates through said pre-combustion chamber, comprises a plurality of axially spaced orbs disposed along the central longitudinal axis of said pre-combustion chamber extending from said upstream end portion of said pre-combustion chamber to said downstream end portion of said pre-combustion chamber.

29. The tool as set forth in claim 26, wherein:

said first obstacle means disposed within said pre-combustion chamber, for retarding said rate of burn of said air-fuel mixture within said pre-combustion chamber, and said speed at which said flame front propagates through said pre-combustion chamber, comprises a plurality of axially spaced plates disposed along the central longitudinal axis of said pre-combustion chamber extending from said upstream end portion of said pre-combustion chamber to said downstream end portion of said pre-combustion chamber.

30. The tool as set forth in claim 26, wherein:

said first obstacle means disposed within said pre-combustion chamber, for retarding said rate of burn of said air-fuel mixture within said pre-combustion chamber, and said speed at which said flame front propagates through said pre-combustion chamber, comprises a plurality of axially spaced discs disposed along the central longitudinal axis of said pre-combustion chamber extending from said upstream end portion of said pre-combustion chamber to said downstream end portion of said pre-combustion chamber.

31. The tool as set forth in claim 20, further comprising:

second obstacle means disposed within said final combustion chamber for ensuring the rapid and complete combustion of said air-fuel mixture within said final combustion chamber such that peak energy and power can be impressed upon said working piston for driving fasteners from the tool and into a substrate.

32. The tool as set forth in claim 31, wherein said second obstacle means disposed within said final combustion chamber for ensuring the rapid and complete combustion of said air-fuel mixture within said final combustion chamber comprises:

a solid geometrical figure disposed within an up-stream end portion of said final combustion chamber and adjacent to said port fluidically interconnecting said pre-combustion chamber to said final combustion chamber for encountering said flame front propagating from said pre-combustion chamber into said final combustion chamber and for splitting said propagating flame front into radially divergent flame front portions for combustibly igniting all regions of said air-fuel mixture disposed within said final combustion chamber.

33. The tool as set forth in claim 32, wherein:

said solid geometrical figure comprises a cone wherein an apex portion of said cone faces said port fluidically interconnecting said pre-combustion chamber to said final combustion chamber.

34. The tool as set forth in claim 32, further comprising:

divergent wall portions partially defining said final combustion chamber and operatively cooperating with said solid geometrical figure for defining annular flow channel portions within which said split radially divergent flame front portions can propagate with an enhanced rate of speed so as to achieve said combustible ignition of all regions of said air-fuel mixture disposed within said final combustion chamber while developing said peak energy and power for impression upon said working piston for driving the fasteners from the tool and into a substrate.

35. The tool as set forth in claim 34, further comprising:

convergent wall portions partially defining said final combustion chamber and disposed downstream from said divergent wall portions partially defining said final combustion chamber for deflecting combustion-generated pressure forces, power, and energy, developed within said final combustion chamber, toward said working piston so as to impact and move said working piston for driving the fasteners from the tool and into a substrate.

36. The tool as set forth in claim 32, wherein:

said solid geometrical figure is selected from the group comprising a cone, a sphere, a plate, and a tear-drop.

37. The tool as set forth in claim 36, wherein:

when said solid geometrical figure comprises one of said cone, sphere, and tear-drop figures, wall portions, partially defining said final combustion chamber, have geometrical configurations which substantially correspond to the contours of side wall portions of said one of said cone, sphere, and tear-drop figures so as to operatively cooperate with said solid geometrical figure for defining annular flow channel portions within which said split radially divergent flame front portions can propagate with an enhanced rate of speed so as to achieve said combustible ignition of all regions of said air-fuel mixture disposed within said final combustion chamber while developing said peak energy and power for impression upon said working piston for driving the fasteners from the tool and into a substrate.

38. The tool as set forth in claim 32, wherein:

said solid geometrical figure has a transverse cross-sectional configuration which is selected from the group comprising a circle, a pentagon, a rectangle, a cross, and an irregular polygon.

39. A combustion chamber system, for use within combustion-powered fastener-driving tools, comprising:

a pre-combustion chamber having an aspect ratio, defined by means of the ratio of the length dimension of said pre-combustion chamber relative to the width dimension of said pre-combustion chamber, which is at least 2:1;

means defined within an upstream end portion of said pre-combustion chamber for initiating combustion of an air-fuel mixture which propagates through said pre-combustion chamber, from said upstream end portion of said pre-combustion chamber to a downstream end portion of said pre-combustion chamber, by means of a flame front;

a final combustion chamber fluidically connected by a port to said downstream end portion of said pre-combustion chamber and having a working piston operatively disposed at a downstream end portion of said final combustion chamber for driving fasteners out from the tool and into a substrate; and obstacle means disposed within said final combustion chamber for encountering said flame front from said pre-combustion chamber and for dispersing the same so as to en-sure the rapid and complete combustion of said air-fuel mixture within said final combustion chamber such that peak energy and power can be impressed upon said working piston for driving fasteners from the tool and into a substrate.

40. The system as set forth in claim 39, wherein said obstacle means disposed within said final combustion chamber for ensuring the rapid and complete combustion of said air-fuel mixture within said final combustion chamber comprises:

a solid geometrical figure disposed within an up-stream end portion of said final combustion chamber and adjacent to said port fluidically interconnecting said pre-combustion chamber to said final combustion chamber for encountering said flame front propagating from said pre-combustion chamber into said final combustion chamber and for splitting said propagating flame front into radially divergent flame front portions for combustibly igniting all regions of said air-fuel mixture disposed within said final combustion chamber.

41. The system as set forth in claim 40, wherein:

said solid geometrical figure comprises a cone wherein an apex portion of said cone faces said port fluidically interconnecting said pre-combustion chamber to said final combustion chamber.

42. The system as set forth in claim 41, further comprising:

divergent wall portions partially defining said final combustion chamber and operatively cooperating with said solid geometrical conical figure for defining annular flow channel portions within which said split radially divergent flame front portions can propagate with an enhanced rate of speed so as to achieve said combustible ignition of all regions of said air-fuel mixture disposed within said final combustion chamber while developing said peak energy and power for impression upon said working piston for driving the fasteners from the tool and into a substrate.

43. The system as set forth in claim 42, further comprising:

convergent wall portions partially defining said final combustion chamber and disposed downstream from said divergent wall portions partially defining said final combustion chamber for deflecting combustion-generated pressure forces, power, and energy, developed within said final combustion chamber, toward said working piston so as to impact and move said working piston for driving the fasteners from the tool and into a substrate.

44. The system as set forth in claim 40, wherein:

said solid geometrical figure is selected from the group comprising a cone, a sphere, a plate, and a tear-drop.

45. The system as set forth in claim 44 wherein:

when said solid geometrical figure comprises one of said cone, sphere, and tear-drop figures, wall portions, partially defining said final combustion chamber, have geometrical configurations which substantially correspond to the contours of side wall portions of said one of said cone, sphere, and tear-drop figures so as to operatively cooperate with said solid geometrical figure for defining annular flow channel portions within which said split radially divergent flame front portions can propagate with an enhanced rate of speed so as to achieve said combustible ignition of all regions of said air-fuel mixture disposed within said final combustion chamber while developing said peak energy and power for impression upon said working piston for driving the fasteners from the tool and into a substrate.

46. The system as set forth in claim 40, wherein:

said solid geometrical figure has a transverse cross-sectional configuration which is selected from the group comprising a circle, a pentagon, a rectangle, a cross, and an irregular polygon.

47. A combustion-powered fastener-driving tool for driving fasteners into substrates, comprising:

a working piston for driving fasteners out from said tool and into a substrate;

a pre-combustion chamber having an aspect ratio, defined by means of the ratio of the length dimension of said pre-combustion chamber relative to the width dimension of said pre-combustion chamber, which is at least 2:1;

means defined within an upstream end portion of said pre-combustion chamber for initiating combustion of an air-fuel mixture which propagates through said pre-combustion chamber, from said upstream end portion of said pre-combustion chamber to a downstream end portion of said pre-combustion chamber, by means of a flame front;

a final combustion chamber fluidically connected by a port to said downstream end portion of said pre-combustion chamber and having said working piston operatively disposed at a downstream end portion of said final combustion chamber for driving the fasteners out from said tool and into the substrate; and obstacle means disposed within said final combustion chamber for encountering said flame front from said pre-combustion chamber and for dispersing the same so as to ensure the rapid and complete combustion of said air-fuel mixture within said final combustion chamber such that peak energy and power can be impressed upon said working piston for driving fasteners from the tool and into a substrate.

48. The tool as set forth in claim 47, wherein said obstacle means disposed within said final combustion chamber for ensuring the rapid and complete combustion of said air-fuel mixture within said final combustion chamber comprises:

a solid geometrical figure disposed within an up-stream end portion of said final combustion chamber and adjacent to said port fluidically interconnecting said pre-combustion chamber to said final combustion chamber for encountering said flame front propagating from said pre-combustion chamber into said final combustion chamber and for splitting said propagating flame front into radially divergent flame front portions for combustibly igniting all regions of said air-fuel mixture disposed within said final combustion chamber.

49. The tool as set forth in claim 48, wherein:

said solid geometrical figure comprises a cone wherein an apex portion of said cone faces said port fluidically interconnecting said pre-combustion chamber to said final combustion chamber.

50. The tool as set forth in claim 49, further comprising:

divergent wall portions partially defining said final combustion chamber and operatively cooperating with said solid geometrical conical figure for defining annular flow channel portions within which said split radially divergent flame front portions can propagate with an enhanced rate of speed so as to achieve said combustible ignition of all regions of said air-fuel mixture disposed within said final combustion chamber while developing said peak energy and power for impression upon said working piston for driving the fasteners from the tool and into a substrate.

51. The tool as set forth in claim 50, further comprising:

convergent wall portions partially defining said final combustion chamber and disposed downstream from said divergent wall portions partially defining said final combustion chamber for deflecting combustion-generated pressure forces, power, and energy, developed within said final combustion chamber, toward said working piston so as to impact and move said working piston for driving the fasteners from the tool and into a substrate.

52. The tool as set forth in claim 48, wherein:

said solid geometrical figure is selected from the group comprising a cone, a sphere, a plate, and a tear-drop.

53. The tool as set forth in claim 52, wherein:

when said solid geometrical figure comprises one of said cone, sphere, and tear-drop figures, wall portions, partially defining said final combustion chamber, have geometrical configurations which substantially correspond to the contours of side wall portions of said one of said cone, sphere, and tear-drop figures so as to operatively cooperate with said solid geometrical figure for defining annular flow channel portions within which said split radially divergent flame front portions can propagate with an enhanced rate of speed so as to achieve said combustible ignition of all regions of said air-fuel mixture disposed within said final combustion chamber while developing said peak energy and power for impression upon said working piston for driving the fasteners from the tool and into a substrate.

54. The tool as set forth in claim 48, wherein:

said solid geometrical figure has a transverse cross-sectional configuration which is selected from the group comprising a circle, a pentagon, a rectangle, a cross, and an irregular polygon.

* * * * *